US007038136B2

(12) United States Patent
King, Jr.

(10) Patent No.: US 7,038,136 B2
(45) **Date of Patent: *May 2, 2006**

(54) LOW TORQUE TWIST-ON WIRE CONNECTOR

(76) Inventor: Lloyd H. King, Jr., 394 Larimore Valley Dr., Wildwood, MO (US) 63005

( * ) Notice: Subject to any disclaimer, the term of this patent is extended or adjusted under 35 U.S.C. 154(b) by 24 days.

This patent is subject to a terminal disclaimer.

(21) Appl. No.: 10/411,715

(22) Filed: Apr. 14, 2003

(65) Prior Publication Data

US 2003/0168239 A1 Sep. 11, 2003

Related U.S. Application Data

(63) Continuation of application No. 09/987,780, filed on Nov. 16, 2001, now Pat. No. 6,570,094.

(60) Provisional application No. 60/251,111, filed on Dec. 5, 2000.

(51) Int. Cl.
*H01R 4/22* (2006.01)

(52) U.S. Cl. ..... 174/87

(58) Field of Classification Search ..... 174/87; 403/214, 268; 203/219, 221; D13/150; 439/415

See application file for complete search history.

(56) References Cited

U.S. PATENT DOCUMENTS

| | | | | |
|---|---|---|---|---|
| 3,676,574 A | | 7/1972 | Johansson et al. | 174/87 |
| 5,113,037 A | | 5/1992 | King, Jr. et al. | 174/87 |
| 5,151,239 A | * | 9/1992 | King, Jr. | 264/272.11 |
| 5,894,110 A | | 4/1999 | Simmons | 174/87 |
| 6,570,094 B1 | * | 5/2003 | King, Jr. | 174/87 |

FOREIGN PATENT DOCUMENTS

GB 791361 2/1956

* cited by examiner

*Primary Examiner*—Chau N. Nguyen
(74) *Attorney, Agent, or Firm*—Jacobson & Johnson

(57) ABSTRACT

A method of making a two-stage twist-on wire connector comprising the steps of forming a housing; placing a spiral thread on an interior of the housing with the spiral thread having an open end and a closed end with a diameter of the open end of the spiral thread larger than the diameter of the closed end, the spiral thread diametrically converging in an axial direction toward the closed end; inserting a lubricant into the closed end of the spiral thread; inserting a plurality of wire ends to be splice into the open end of the spiral thread; twisting the plurality of wires and the wire connector to draw the plurality of wire ends proximate the closed end of the spiral thread to improve the continuity of said the splice; and applying the lubricant to the spiral threads by the twisting engagement of the wires with respect to the spiral threads.

10 Claims, 3 Drawing Sheets

Prior Art FIG. 1
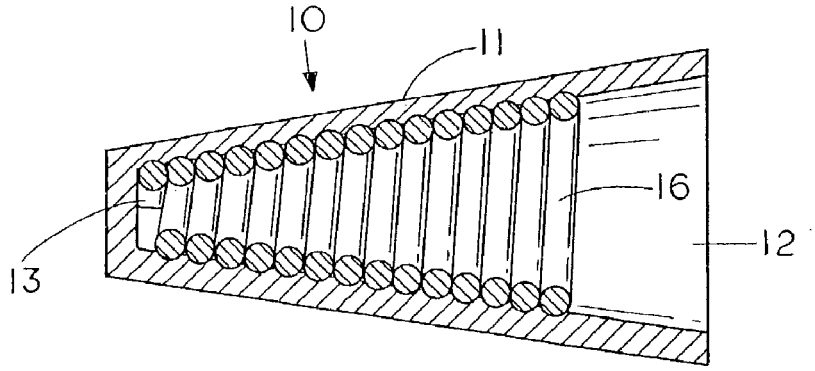
FIG. 2
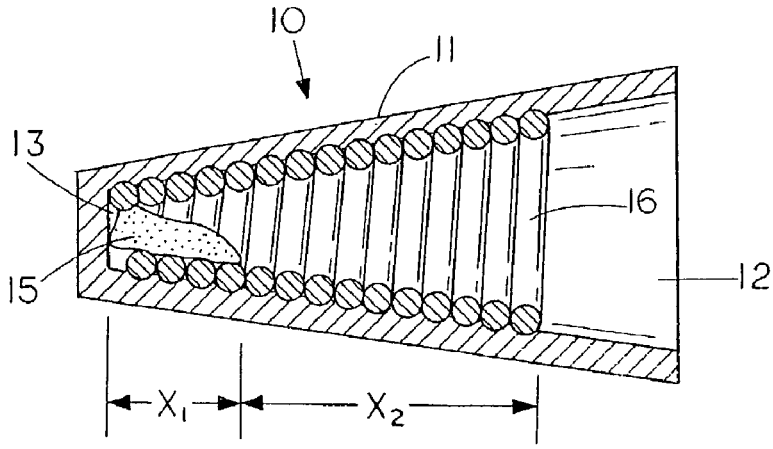
FIG. 3
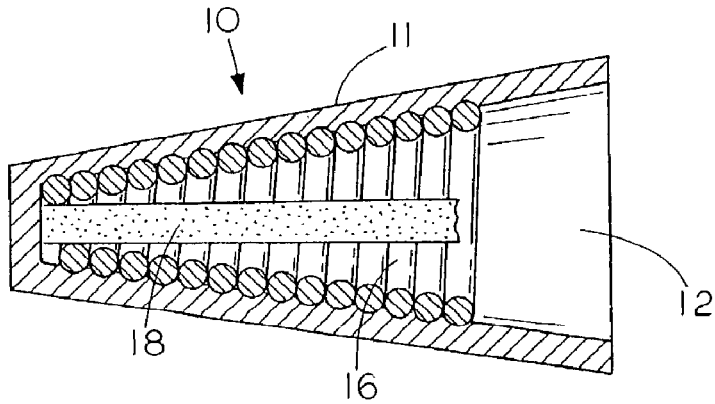

LOW TORQUE TWIST-ON WIRE CONNECTOR

CROSS REFERENCE TO RELATED APPLICATIONS

This application claims is a continuation application of U.S. application Ser. No. 09/987,780, filed on Nov. 16, 2001 now U.S. Pat. No. 6,570,094, claiming priority from provisional application titled LOW TORQUE TWIST-ON WIRE CONNECTOR U.S. Ser. No. 60/251,111, filed Dec. 5, 2000.

FIELD OF THE INVENTION

This invention relates generally to wire connectors, and more specifically, to a twist-on wire connector having a lubricant thereon to reduce the torque required to set the electrical wires in the wire connector and at the same ensure that the electrical wires are securely engaged so that normal thermal expansion and contraction or shock and vibration conditions will not cause the wires to loosen in the connector.

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of wire connectors for connecting the junction of two or more wires together by twisting a cap on the wires is old in the art. Wire connectors are well known in the art and generally comprise an outer housing with a tapered threaded interior to permit a user to insert wires into the tapered opening. To use a wire connector, the user inserts the twisted ends of electrical wires into a cavity on the inside of the wire connector. The user then holds the wire in one hand and with the other hand twists the wire connector. The twisting action pulls the junction ends of the wires into a low resistance electrical contact.

If the connector is located in a wet location it is necessary to place a waterproof sealant around the connector. In order to prevent water or moisture from entering the connector and forming an oxidation layer over the ends of the wire the user inserts the wire connector and the wire into some type of a waterproof potting compound. The compound may be either a non hardening or a hardening compound. In either case the compound creates a waterproof capsule over the wire connector and the junction ends of the electrical wires.

The prior art process is time consuming because it involves two separate steps as well as the nuisance of having separate potting compounds and containers to hold the potting compound. A second generation improved twist-on wire connector wherein the wires can be encapsulated and sealed in a twist on wire connector to prevent water or moisture from entering the connector is shown in my U.S. Pat. Nos. 5,113,037; 5,023,402 and 5,151,239. The second generation twist-on wire connectors permits the user in one continuous action to simultaneously form the junction ends of wire leads into a low resistance electrical connection that is surrounded by a waterproof sealant to form a waterproof covering around the junction ends of the wire leads.

Under certain dynamic conditions, such as vibration and shock, or large temperature changes the wires in the twist-on wire connector can become loosened and thus lower the integrity of the connection between the wires in the twist on wire connectors by either increasing the electrical resistance or decreasing the contact area or both. I call the present invention a third generation electrical twist-on wire connector wherein the integrity of the low resistance electrical connection of the twist-on wire connector is actually enhanced by placing a small amount of self-adhering lubricant in the twist-on wire connector. Generally, to enhance the electrical conductive between connector and wire one needs only a small amount of self-adhering lubricant to provide an enhanced low resistance electrical connection. In the present invention, it has been found that when a small amount of a self-adhering lubricant has been incorporated into the wire connector it results in an enhanced low resistance electrical connection.

In order to ensure that twist-on wire connectors remain in a low-resistance electrical connection when subject to environmental conditions of shock and vibration one prior art method is to encapsulate the twist-on wire connectors in a solid resin. In other methods tools may be used to apply extra torque to the wires to cause further engagement of the threads of the wire connector with the electrical wires. In the present method one need not resort to encapsulation with a solidified resin and one need not resort to using tools to enhance the torque since it has been found that even though a lubricant is used the suspected detrimental effects of use of a lubricant film between the wire and the wire connector is overcome by the greater physical engagement between the wires which can be obtained by use of the lubricant. That is, the lubricant allows one to reduce the torque that may be required to make a secure connection in a twist-on wire connector. As a result one can hand tighten a twist-on wire connector containing a small amount of self-adhering lubricant and provide for greater electrical contact between the wires which results in retention of the low-resistance electrical connection even in the presence of forces such as vibration and shock.

SUMMARY OF THE INVENTION

Briefly, the present invention is an improved twist-on wire connector that permits the user to form the junction ends of wire leads into a low resistance electrical connection with the twist-on wire connector including a self adhering lubricant located along a portion of the interior of the twist-on wire connector. The wires are drawn into the housing by a spiral thread through the twisting action of the wires with respect to housing. As the wires are drawn into the spiral thread, the frictional resistance to the rotation of the wires increases until the wires can no longer be hand twisted into the wire connector. Once the wires are drawn into contact with the lubricant the torque resistance, which is a result of frictional resistance between the wires and the spiral thread, decreases while the radial compressive forces between the wires and the spiral thread are substantially unaffected. Consequently, the rate of torsonial resistance decreases allowing the wires to be brought into further electrical contact along a greater length through only hand tightening while at the same time the radially compressive forces on the wires are greater thus ensuring a low resistance electrical contact that remains stable over an extending period of time. Because only a small amount of self-adhering lubricant is needed within the wire connector to provide an enhanced low-resistance electrical connection problems of the self-adhering lubricant accidentally coming into contact with the exterior housing of other twist-on wire connectors is minimized even if caps are not used on the twist-on wire connectors.

BRIEF DESCRIPTION OF THE DRAWINGS

FIG. 1 is a cross-sectional view showing a twist-on wire connector free of any lubricant;

FIG. 2 is a cross-sectional view showing a twist-on wire connector with a lubricant located at the end of the spiral thread;

FIG. 3 is a cross-sectional view showing a twist-on wire connector with a lubricant extending axially along the spiral thread;

DESCRIPTION OF THE PREFERRED EMBODIMENT

Figure 4:
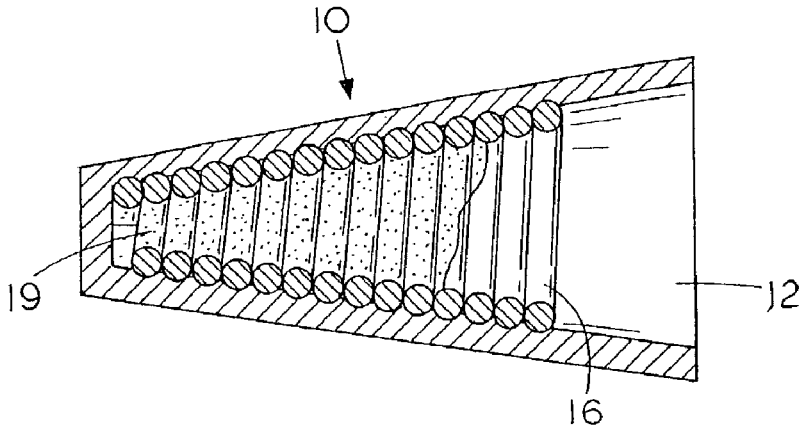
FIG. 4 is a cross-sectional view showing a twist-on wire connector with a lubricant film extending around the spiral thread of the twist-on wire connector.

Referring to FIG. 1, reference numeral 10 generally identifies a conventional twist-on wire connector. Wire connector 10 includes an electrical insulating housing 11 having an open end 12 and a closed end 13 with the diameter of open end 12 being larger than the diameter of closed end 13. A spiral thread 16 extends axially inwardly in housing 11. The diameter of spiral thread 16 proximate open end 12 of housing 11 is larger than the diameter of spiral thread 16 proximate closed end 13 of housing 11 so that wires are squeezed into tighter contact with each other as the wires are twisted into the spiral thread. While the embodiment shows that the spiral thread is a metal spring it is envisioned that the spiral thread could be integrally formed within the housing of the twist-on wire connector.

FIG. 2 shows an embodiment of the present invention having a self-adhering lubricant 15 positioned at the closed end 13 of connector 10. The self-adhering lubricant 15 extends an axial distance $x_1$ along the spiral threads. In contrast, the spiral threads designated by $x_2$ are free of self-adhering lubricant.

FIG. 3 shows a further embodiment of the present invention having a self-adhering lubricant strip 18 positioned axially along the spiral thread 16. The amount of self-adhering lubricant is sufficient to provide lubrication between the contact surfaces of the wires and the spiral thread but insufficient to fill the spiral thread and encapsulate the wires.

FIG. 4 shows a further embodiment of the present invention having a self-adhering lubricant film extending axially along the spiral thread 16. The amount of self-adhering lubricant is sufficient to provide a thin lubrication film between the contact surfaces of the wires and the spiral thread but insufficient to fill the spiral thread and encapsulate the wires. That is, a preferred method of placing the lubricant in the wire connector is to apply a film of lubricant to a portion of the threads of the wire connector.

Figure 5:
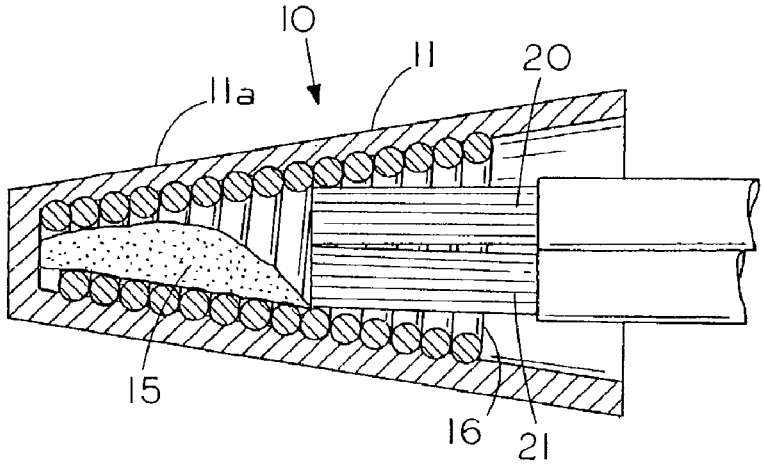
FIG. 5 is a cross-sectional view showing a twist-on wire connector with a lubricant located at the end of the spiral thread and a pair of wires engaging the spiral thread, which is free of lubrication.

FIG. 5 shows the twist-on wire connector 10 with self-adhering lubricant 15 positioned at the closed end of the wire connector and a pair of electrical wires 20, 21 engaging the outer portion of the spiral thread 16, which is free of self adhering lubricant. This illustrates the first step in the engagement of the wires with the twist on wire connectors. That is, a rotation of the twist-on wire connector 10 with respect to wires 20 and 21 produces contact engagement between the two causing the wires to be drawn deeper into the cavity within the twist-on wire connector. In the embodiment shown the engagement between the wires 20, 21 and the spiral thread 16 is direct without the presence of any lubricant. As the wires are drawn into the spiral thread the torsonial resistance to twisting the wires increases.

Figure 6:
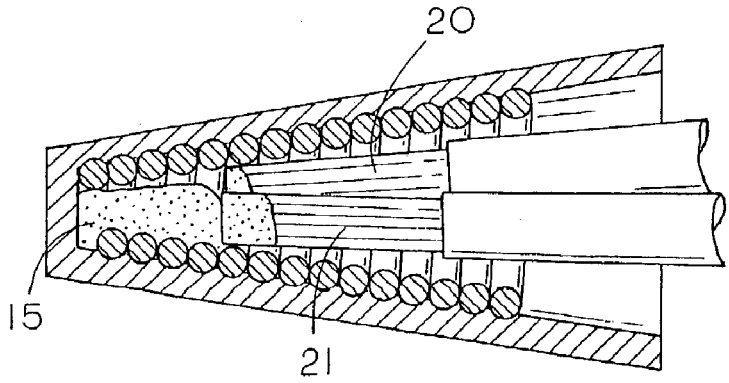
FIG. 6 is a cross-sectional view showing the twist on wire connector of FIG. 5 with the wires engaging the lubricant on the spiral threads.

FIG. 6 illustrates the twist-on wire connector of FIG. 5 once the wires 20 and 21 engage the self-adhering lubricant 15. Once the wires engage the self adhering lubricant 15 further twisting action cause the lubricant 15 to form a film between the spiral threads 16 and the wires 15 thereby decreasing the torsional frictional resistance to twisting the wires while maintaining the radially compressive forces on the electrical wires. FIG. 6 shows the twist-on wire connector 10 with an open end; however, if desired a cap such as shown in U.S. Pat. No. 5,113,037 could be placed on the end.

A number of lubricants are usable in the present invention, suitable lubricants are of the type that will remain insitu within the wire connector during normal handling. As the lubricant is not required to form a filling or enclosure that encapsulates the wires a wide range of lubricants from liquids to solids can be used. For example, liquid lubricants that will adhere to a surface and form a film thereon are suitable for use with the present invention since the lubricant need only reduce the torsional frictional resistance between the wires and the spiral thread. In certain applications, the lubricant may be electrically conductive; however, a non-electrically conductive lubricant can also be used. It is envisioned that thermosetting resins could also be used provided that the thermosetting resins have lubricating qualities and can adhere to the spiral thread when in a liquid state. As can be seen from the drawings only a small amount of lubricant is needed to obtain the benefit of the present invention. That is, only sufficient lubricant is required to form a reduced frictional resistance between the wires and the spiral thread.

Figure 7:
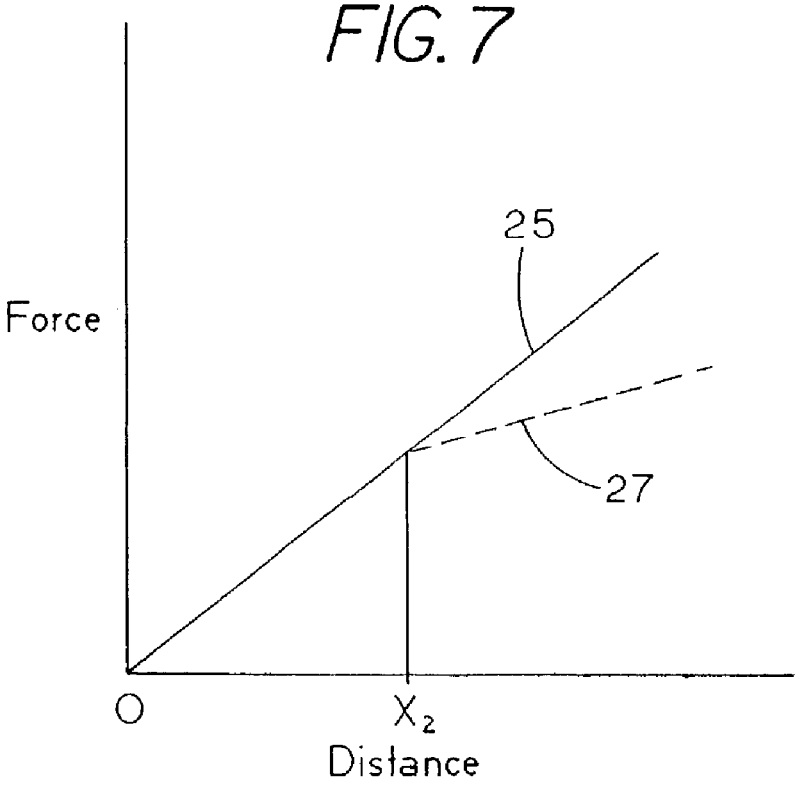
FIG. 7 is a diagram illustrating the torsional resistance as a function of wire penetration both with and without the use of a lubricant.

A reference to FIG. 7 provides a quantitative guide to the torsonial force in engaging a twist on wire connector with a set of wires. The torsonial force is located along the vertical axis and the penetration distance is located along the horizontal axis. The solid line, which is identified by reference numeral 25, shows the general increase of torsonial force as a function of penetration of the wires into the connector when there is no lubricant present. The dashed line 27 illustrates the torsonial force as the twist-on wire connector is twisted on to the wires when lubricant is present on a portion of the spiral thread. When the lubricant is present on only a portion of the spiral thread he torsional force increases up to the distance $x_1$ which indicates the point where the wires engage the self adhering lubricant. Once the wires engage the self adhering lubricant the rate of increase of torsional resistance as indicated by dashed line 27 increases at a lesser rate allowing a user to bring the wires deeper into the wire connector while using less force. Since the deeper the wires are in the twist-on electrical connector the greater the radially compressive forces between the spiral threads and the wires the better the electrical contact between the wires and the spiral thread.

Thus part of the present invention comprises a method of making a two-stage twist-on wire connector which comprises the steps of forming a housing 11 having an exterior surface 11*a* for hand grasping by a user. Placing a spiral thread 16 on the interior of the housing 11 with the spiral thread having an open end and a closed end with a diameter of the open end of the spiral thread larger than the diameter of the closed end with the spiral thread diametrically converging in an axial direction toward the closed end. Next one inserts a self adhering lubricant into the closed end of the spiral thread with the lubricant partially covering the spiral thread proximate the closed end thereby leaving a further portion of the spiral thread proximate the open end free of lubricant. Normally, a plurality of wires which require N turns of the twist-on wire connector to fully engage the plurality of wires with the spiral thread which is free of lubricant and M additional turns of the twist-on wire connector to fully engage the plurality of wires with the spiral thread carrying the lubricant. The spiral thread with the lubricant thereon reduces the requirement for increased torque on the twist-on wire connector that might normally require the use of a separate tool to turn the twist-on connector to fully engaged position with the plurality of wires. To complete the connection one inserts a plurality of wire ends to be spliced into the open end of the spiral thread and twists the spiral thread with respect to the plurality of wires 20, 21 to draw the plurality of wire ends proximate the closed end of the spiral thread and into grater radial compression to thereby improve the continuity and long term stability of the electrical connection.

With the present invention it will be appreciated that with only a strip or a small amount of lubricant in the. wire connector is sufficient to provide reduced torsional friction since the twisting action of wires with respect to the spiral thread apples the lubricant to the surfaces by dragging or pulling the lubricant along as wires are rotated with respect to the spiral thread of the connectors. Consequently, only a small amount of lubricant need be used in the spiral thread and the placement of the lubricant on a portion of the spiral thread surface which contacts a rotating wire will automatically become lubricated by the action of engaging the wire connector with the wires. The lubricants in use with the present invention can be dielectric or non-dielectric lubricants as well as either electrical insulating or non-electrical insulating sealants.

Figure 8:
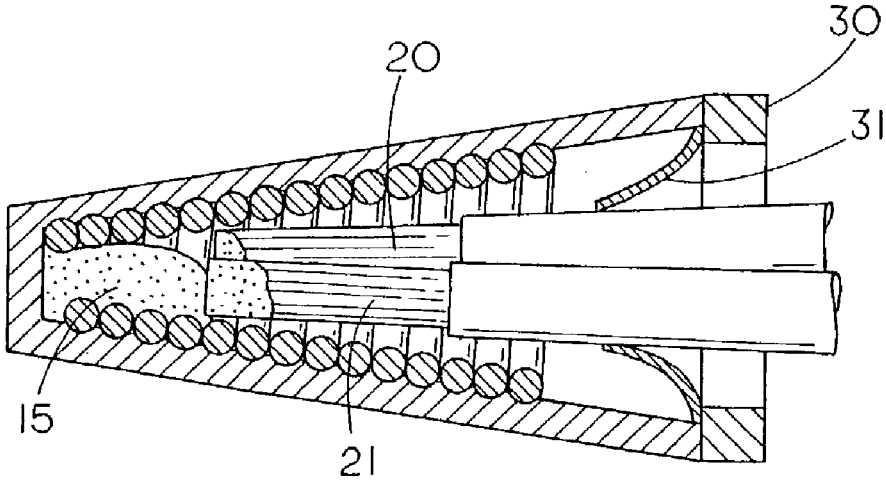
FIG. 8 is a cross-sectional view showing the twist on wire connector of FIG. 5 with a cover on the end of the wire connector.

While the low amount of lubricant used with the present invention makes it ideally suitable for use without a cap the embodiment shown in FIG. 8 includes a cap 30 having a set of radially projecting flexible member that part to allow penetration of the wires into the cavity of the electrical twist-on wire connector. An example of a cap is shown and my U.S. Pat. No. 5,113,037 which is hereby incorporated by reference.

As an alternative method the spiral thread can be precoated or plated with a metal that functions as a lubricant. Such preplating is not limited to metals, for example, materials such as polytetrafluoroethylene (Teflon) could be placed on the spiral threads to reduce the frictional requirements. A result of the low resistance connection of the present invention is that the connection between wires remains cooler and hence more efficient.

While the preferred method is to apply a film of lubricant to the wire connector it is envisioned that a method of the present invention could involve applying the film of lubricant to a wire to be brought into electrical contact by the threads of the wire connector.

Thus the present invention is a twist-on wire connector for maintaining the integrity of an electrical connection therein including a housing for grasping in a user's hand, with the housing having an open end and a closed end, a spiral thread located within the housing, the spiral thread extending inwardly in the housing with the spiral thread having a larger diameter proximate the open end of the housing and a smaller diameter portion proximate the closed end of the housing. The spiral thread having a portion free of a lubricant and a further portion carrying a film of lubricant with the film of lubricant carried by the spiral tread insufficient to encapsulate and waterproof a plurality of electrical wires located therein. While two electrical wires are shown the present invention is suitable for use with more or less wires. In addition, the present invention and method is not only suitable for use with conventional electrical voltages it is also suitable low voltage applications included in applications such as speaker wires or the like.

In another embodiment the twist-on wire connector for maintaining the integrity of an electrical connection therein includes a housing for grasping in a user's hand; a spiral thread located within the housing with the spiral thread extending inwardly in the housing with the spiral thread having a larger diameter proximate an open end of the housing and a smaller diameter portion proximate a closed end of the housing. A film of lubricant or a small amount of lubricant is carried by the spiral tread with the film of lubricant insufficient to encapsulate and waterproof a plurality of electrical wires located therein but sufficient to reduce frictional resistant between a contact area located between the plurality of wires and the spiral thread to thereby provide for an enhanced contact area without enhancing an amount of torque applied to the plurality of wires.

A method of the present invention includes the making a low resistance electrical resistance connection to withstand adverse environmental conditions due to changes in temperature by placing an electrical wire having a exterior surface proximate to a twist-on wire connector having a wire engaging surface; placing a lubricant on either the exteriors surface or the wire engaging surface; and rotating the electrical wire to create a contact area between the wire engaging surface and the exterior surface and continuing to rotate the electrical wire to form an increased contact area having a low electrical resistance there across.

I claim:

1. A method of making connection to withstand adverse environmental conditions due to changes in temperature comprising:

placing an electrical wire having an exterior surface proximate to a twist-on wire connector having an electrical wire engaging surface;

placing a lubricant on either the exterior surface or the electrical wire engaging surface;

rotating the electrical wire to create a contact area between the wire engaging surface and the exterior surface and continuing to rotate the electrical wire to secure the electrical wire in the twist-on wire connector; and ensuring that a lubricant on either the exterior surface or the electrical wire engaging surface is sufficient to provide lubrication between a contact surface of the electrical wire engaging surface and a spiral thread but insufficient to fill the spiral thread and encapsulate the wire.

2. The method of claim 1 wherein the step of placing the lubricant comprises placing a solid lubricant on either the exterior surface or the electrical wire engaging surface.

3. A method of making connection to withstand adverse environmental conditions due to changes in temperature comprising:

placing an electrical wire having an exterior surface proximate to a twist-on wire connector having an electrical wire engaging surface;

placing a lubricant on either the exterior surface or the electrical wire engaging surface;

rotating the electrical wire to create a contact area between the wire engaging surface and the exterior surface and continuing to rotate the electrical wire to secure the electrical wire in the twist-on wire connector; and first engaging the wire with a portion of spiral thread having no lubricant and then engaging the wire with a portion of a spiral thread having the lubricant to provide a reduced frictional resistance to securement of the wire in the twist-on wire connector.

4. The method of clam 3 including the step of placing of the lubricant in a closed end of a spiral thread.

5. The method of claim 3 wherein the step of placing the lubricant comprises placing a self-adhering lubricant into a closed end of the spiral thread.

6. The method of clam 3 including the step of pulling the lubricant along as the wire is rotated.

7. A method of making connection to withstand adverse environmental conditions due to changes in temperature comprising;

placing an electrical wire having a exterior surface proximate to a twist-on wire connector having an electrical wire engaging surface;

placing a lubricant on an exposed portion of a spiral there in the twist-on wire connector wherein the lubricant is sufficient to provide lubrication between the wire engaging surface and a spiral thread but insufficient to fill the spiral thread and encapsulate the wire and;

rotating the electrical wire to create a contact area between the wire engaging surface and the exterior surface and continuing to rotate the electrical wire to secure the electrical wire in the twist-on wire connector.

8. The method of claim 7 including the step of placing a cap on the twist-on wire connector.

9. The method of claim 8 including the step of dragging or pulling the lubricant along as the wire is rotated with respect to the spiral thread.

10. The method of claim 9 including the step of drawing wherein the step of dragging or pulling the lubricant along as the wire is rotated includes rotating at least two electrical wires into the spiral thread.

* * * * *